US005903251A

United States Patent [19]

Mori et al.

[11] Patent Number: 5,903,251

[45] Date of Patent: May 11, 1999

[54] LIQUID CRYSTAL APPARATUS THAT CHANGES A VOLTAGE LEVEL OF A CORRECTION PULSE BASED ON A DETECTED TEMPERATURE

[75] Inventors: Hideo Mori, Yokohama; Tomoyuki Ohno, Atsugi, both of Japan

[73] Assignee: Canon Kabushiki Kaisha, Tokyo, Japan

[21] Appl. No.: 08/790,738

[22] Filed: Jan. 27, 1997

[30] Foreign Application Priority Data

Jan. 29, 1996 [JP] Japan ..... 8-013378

[51] Int. Cl.[6] ..... G09G 3/36

[52] U.S. Cl. ..... 345/101; 345/94

[58] Field of Search ..... 345/101, 94–97; 349/72

[56] References Cited

U.S. PATENT DOCUMENTS

| | | | |
|---|---|---|---|
| 4,367,924 | 1/1983 | Clark et al. | 350/334 |
| 4,923,285 | 5/1990 | Ogino et al. | 350/331 |
| 4,952,032 | 8/1990 | Inoue et al. | 349/72 |
| 4,962,376 | 10/1990 | Inoue et al. | 345/101 |
| 5,033,822 | 7/1991 | Ooki et al. | 350/331 T |
| 5,267,065 | 11/1993 | Taniguchi et al. | 359/56 |
| 5,270,848 | 12/1993 | Takabayashi et al. | 359/88 |
| 5,283,564 | 2/1994 | Katakura et al. | 345/94 |

FOREIGN PATENT DOCUMENTS

| | | |
|---|---|---|
| 63-65425 | 3/1988 | Japan . |
| 2281233 | 11/1990 | Japan . |

*Primary Examiner*—Jeffery Brier

*Attorney, Agent, or Firm*—Fitzpatrick, Cella, Harper & Scinto

[57] ABSTRACT

A liquid crystal apparatus includes a liquid crystal device formed by a pair of substrates having thereon a group of scanning electrodes and a group of data electrodes intersecting the scanning electrodes so as to form an electrode matrix, and a liquid crystal disposed between the substrates so as to form a pixel at each intersection of the scanning electrodes and the data electrodes; and temperature-detection means for detecting a temperature of the liquid crystal device. The liquid crystal device is driven by applying a scanning signal comprising a clear pulse, a write pulse and a correction pulse to the scanning electrodes and for applying data signals to the data electrodes in synchronism with the scanning signal, while changing a voltage level of the correction pulse based on temperature data from the temperature-detection means. As a result, the liquid crystal device can effect a stable display over the entire area even if it has a temperature distribution therealong.

13 Claims, 9 Drawing Sheets

LIQUID CRYSTAL APPARATUS THAT CHANGES A VOLTAGE LEVEL OF A CORRECTION PULSE BASED ON A DETECTED TEMPERATURE

FIELD OF THE INVENTION AND RELATED ART

The present invention relates to a liquid crystal apparatus including a liquid crystal device (panel) provided with an electrode matrix for driving, particularly a liquid crystal apparatus or liquid crystal drive system wherein a scanning signal is caused to have a voltage level varying depending on a temperature distribution along the liquid crystal device.

Hitherto, there has been a well-known type of liquid crystal apparatus including a liquid crystal device (panel) comprising a pair of substrates having thereon a group of scanning electrodes and a group of data electrodes intersecting the scanning electrodes to form an electrode matrix, and a liquid crystal disposed between the substrates so as to form a pixel at each intersection of the scanning electrodes and the data electrodes. Among them, a liquid crystal device using a ferroelectric liquid crystal having a bistability and a quick responsiveness to an applied electric field has been expected as a high-speed memory-type liquid crystal device as proposed in U.S. Pat. No. 4,367,924.

The liquid crystal device may be driven according to a matrix drive scheme as disclosed in many prior references, such as Japanese Laid-Open Patent Application (JP-A) 2-281233. FIG. 8 is a time-serial waveform diagram illustrating a portion of example set of conventional drive signals. Referring to FIG. 8, at A is shown a scanning signal (including a scanning selection signal followed by a scanning non-selection signal) applied to an n-th scanning electrode (n: integer), at B is shown a scanning signal applied to an n+1-th scanning electrode, and at C is shown a train of data signals applied to a data electrode. Each scanning selection signal is applied over two horizontal scanning periods (i.e., period of 1H×2) and includes a clear pulse, a write pulse and a correction pulse Pf for increasing the drive margin. The correction pulses Pf may be held at a constant voltage level, e.g., as disclosed in JP-A 2-281233.

Such a liquid crystal device (panel) is frequently used in a vertically upright state and, when a temperature distribution in a housing in which the panel is incorporated reaches a saturated state, an upper position and a lower position of the panel are liable to have higher and lower temperatures due to air convection within the housing, etc. Further, in a short period from the start-up of the apparatus, e.g., from the initial power supply to the apparatus, a lower part (or an upper part) of the panel is liable to have a higher temperature if a power supply is disposed, e.g., at a lower part (or an upper part) of the apparatus.

A liquid crystal material used in such a liquid crystal panel is generally known to have a peculiar temperature-dependence of its optical response characteristic such that liquid crystal molecules can generally respond to a relatively low voltage in a high-temperature environment, and a high voltage is required to cause a response of the liquid crystal molecules in a low-temperature environment.

On the other hand, FIGS. 9A–9C illustrate another set of time-serial drive waveforms. FIG. 9A shows a scanning (selection) signal including only a clear pulse and a write pulse and no correction pulse; FIG. 9B shows a succession of data signals applied to a data electrode in synchronism with the scanning signal for displaying a bright state on all the pixels on the data electrode and a corresponding voltage waveformed applied to a pixel at an intersection of the data electrode and the scanning electrode; and FIG. 9C shows a succession of data signals applied to another data electrode in synchronism with the scanning signal for displaying a bright state on all the pixels on the data electrode and a corresponding voltage waveformed applied to a pixel at an intersection of the data electrode and the scanning electrode. As indicated by arrows a and b in FIGS. 9B and 9C, a pixel written into the bright (white, W) state is immediately thereafter supplied with a pulse having a polarity for a dark (i.e., reverse) side (at a in FIG. 9B), and a pixel written in the dark (black, B) state is immediately thereafter supplied with a pulse having a polarity for a reverse bright side (at b in FIG. 9C, i.e., an insufficient pulse for writing "W" after resetting to "B" by application of the clear pulse). In this instance, a switching threshold of a liquid crystal is temperature-dependent, so that the length of one horizontal scanning period (1H) (accordingly the pulse width of the write pulse) has been modulated depending on temperature data obtained by a temperature detection means, so as to reliably cause the switching according to a conventional temperature compensation scheme.

As a result of our experiments and further study, it has been observed in some cases that a pixel written in one state is unintentionally inverted into the other state even by effecting the above-mentioned temperature compensation. This difficulty can be alleviated to some extent by introducing a correction pulse Pf as shown in FIG. 8 but it is difficult to realize a sufficient improvement in case where a large temperature distribution (difference) is developed over the extension of a liquid crystal panel.

SUMMARY OF THE INVENTION

An object of the present invention is to provide a liquid crystal apparatus capable of realizing a good display in an inexpensive manner even when a temperature distribution is present over a liquid crystal device (panel).

According to the present invention, there is provided a liquid crystal apparatus, comprising:

- a liquid crystal device comprising a pair of substrates having thereon a group of scanning electrodes and a group of data electrodes intersecting the scanning electrodes so as to form an electrode matrix, and a liquid crystal disposed between the substrates so as to form a pixel at each intersection of the scanning electrodes and the data electrodes,
- temperature-detection means for detecting a temperature of the liquid crystal device,
- drive means for applying a scanning signal comprising a clear pulse, a write pulse and a correction pulse to the scanning electrodes and for applying data signals to the data electrodes in synchronism with the scanning signal, and
- voltage control means for changing a voltage level of the correction pulse based on temperature data from the temperature-detection means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In a preferred embodiment, the voltage control means sets the correction pulse of the scanning signal to have a lower voltage level (or a smaller voltage amplitude, with respect to a prescribed potential level, typically that of a non-selected scanning electrode (i.e., a scanning electrode not receiving a scanning (selection) signal)) at a lower temperature, and a higher voltage level (or a larger voltage amplitude) at a higher temperature.

It is further preferred that, at a lower temperature, the write pulse is set to have a larger voltage amplitude and the correction pulse is set to have a smaller voltage amplitude; and, at a higher temperature, the write pulse is set to have a smaller voltage amplitude and the correction pulse is set to have a larger voltage amplitude.

Alternatively, it is also preferred that, at a lower temperature, the write pulse is set to have a larger pulse width and the correction pulse is set to have a smaller voltage amplitude; and, at a higher temperature, the write pulse is set to have a smaller pulse width and the correction pulse is set to have a larger voltage amplitude.

It is also preferred that, at a lower temperature, the correction pulse is set to have a larger pulse width and a smaller voltage amplitude; and, at a higher temperature, the correction pulse is set to have a smaller pulse width and a larger voltage amplitude.

In a preferred embodiment, the voltage control means changes the voltage level of the correction pulse based on a table showing a relationship between the detected temperature and a temperature distribution of the liquid crystal device.

In the present invention, it is preferred to use a chiral smectic liquid crystal showing ferroelectricity or antiferroelectricity. It is particularly preferred to use a ferroelectric liquid crystal.

It is further preferred to detect temperatures at plural positions of the liquid crystal device and, based on the temperature distribution along the liquid crystal device, supply to the respective scanning electrodes with scanning signals including correction pulses having voltage levels which vary locally. More specifically, at a position of a lower detected temperature, the corresponding scanning electrode (s) are caused to receive a scanning signal including a correction pulse having a smaller voltage amplitude and, at a position of a higher temperature, the corresponding scanning electrode(s) are caused to receive a scanning signal including a correction pulse having a larger voltage amplitude.

Figure 1:
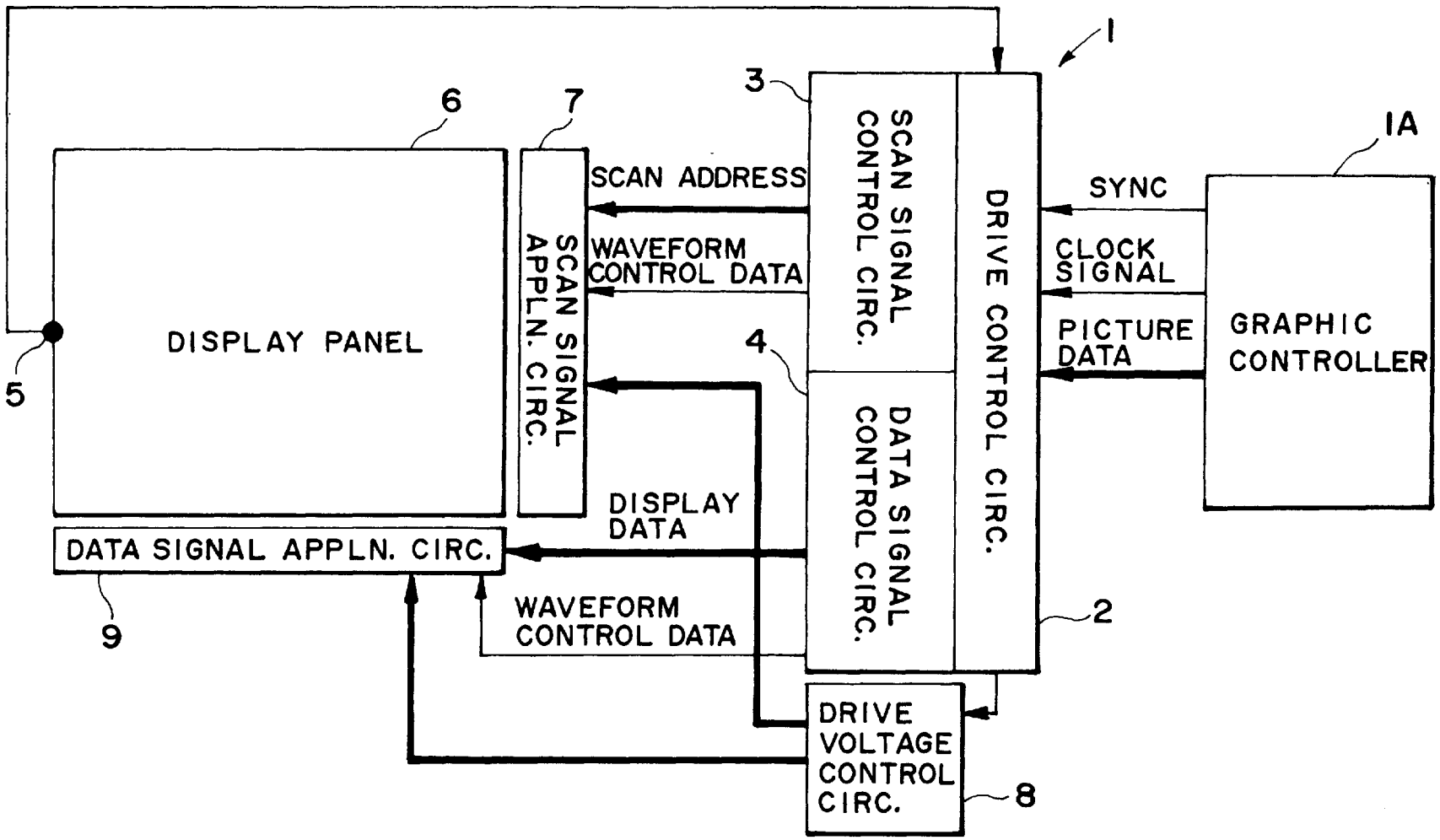
FIG. 1 is a block diagram of an embodiment of the liquid crystal apparatus according to the invention.

FIG. 1 is a block diagram of a liquid crystal apparatus 1 according to an embodiment of the present invention. Referring to FIG. 1, the liquid crystal apparatus 1 includes a graphic controller 1A. Respective signals (including a synchronizing signal SYNC, clock pulse signals and picture data signals) are supplied first to a drive control circuit 2 and then to a scanning signal control circuit 3 and a data signal control circuit 4, where the signals are converted into scanning address data and display data.

The apparatus further includes a liquid crystal device (picture display panel) 6 provided with a temperature detection element 5, such as a thermistor, as a temperature detection means for detecting the temperature of the liquid crystal in the liquid crystal device (more precisely, the temperature of a part of the liquid crystal device for evaluating the temperature of the liquid crystal contained in the device close to the detected part). Temperature data from the temperature detection element 5 is first inputted to the drive control circuit 2 to be converted into waveform control data, which is inputted to the scanning signal control circuit 3 and then supplied to the scanning signal application circuit 7 from the control circuit 3.

Based on the temperature data, the drive control circuit 2 supplies voltage control data to the liquid crystal drive voltage control circuit 8 as a voltage control means. Based on the voltage control circuit 8 generates liquid crystal drive voltages, which are supplied to the scanning signal application circuit 7 and the data signal application circuit 9. Further details of the liquid crystal drive voltage control circuit 8 will be described later.

A scanning signal waveform is generated by the scanning signal application circuit 7 based on the scanning address data and waveform control data received from the scanning signal control circuit 3 and the liquid crystal drive voltages received from the liquid crystal drive voltage control circuit 8, and the generated scanning signal waveform is supplied to scanning electrodes (not specifically shown) of the display panel 6. On the other hand, based on the display data and data signal waveform control data received from the data signal control circuit 4 and the liquid crystal drive voltages received from the liquid crystal drive voltage control circuit 8, the data signal application circuit 9 generates data signal waveforms, which are supplied to data electrodes (not specifically shown) of the display panel 6.

Figure 2:
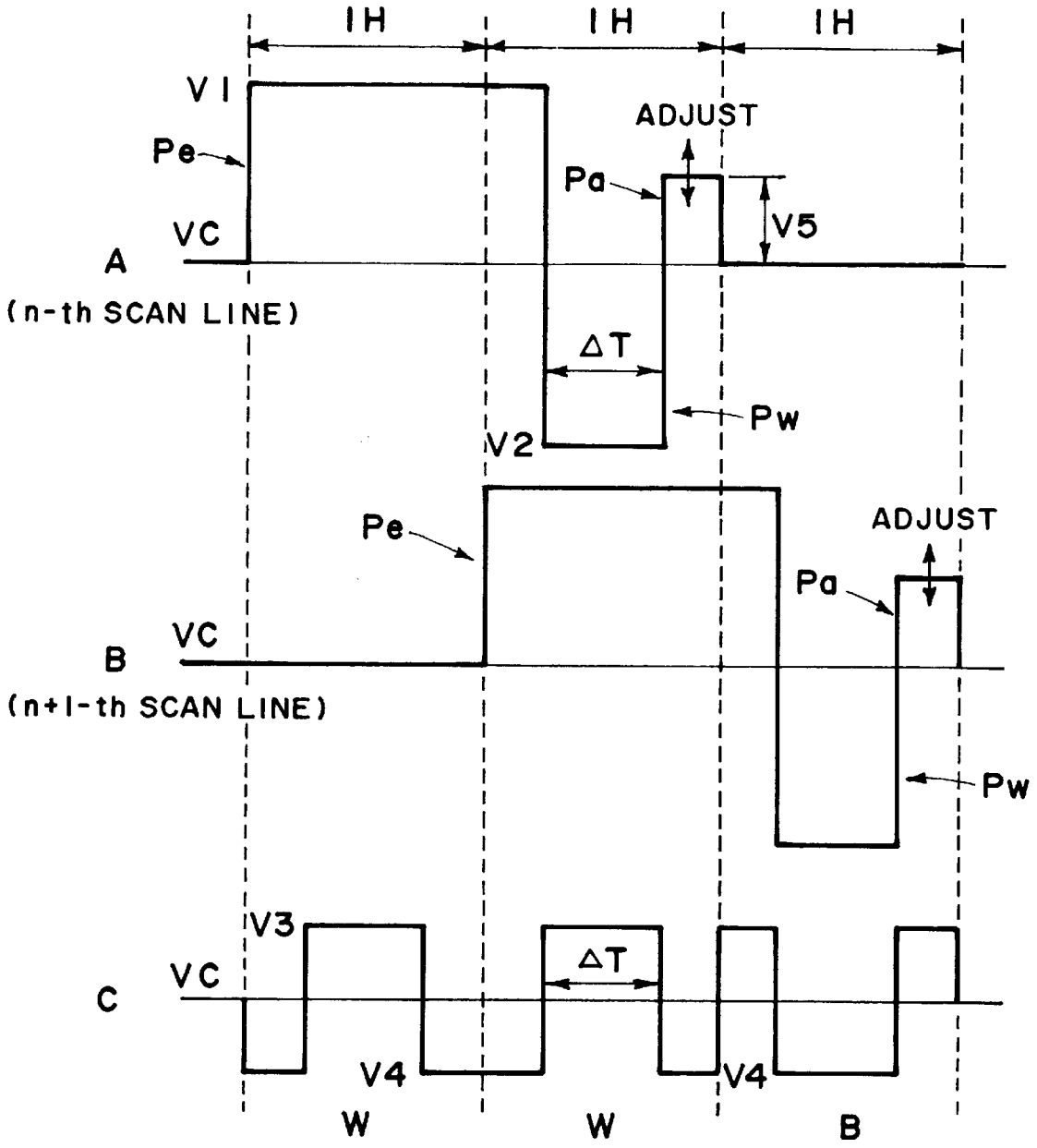
FIG. 2 is a time-serial waveform diagram showing a partial set of drive signals used in First embodiment of the invention.

FIG. 2 is a time-serial waveform diagram showing such a scanning signal waveform (at A and B) and a data signal waveform (at C) supplied to the scanning electrodes and the data electrodes, respectively, from the scanning signal application circuit 7 and the data signal application circuit 9, respectively. More specifically, referring to FIG. 2, at A is shown a scanning signal waveform applied to an n-th scanning electrode (i.e., a scanning electrode having a scanning address n, n: a positive integer), at B is shown a scanning signal waveform applied to an n+1-th scanning electrode, and at C is shown a data signal waveform including three data signals for displaying "W" (white), "W" (white) and "B" (black). More specifically, the data signals shown at C are applied so as to display "W" (white) at the time of n-th scanning (or at a pixel on the n-th scanning line) and "B" (black) at the time of n+1-th scanning (at a pixel on the n+1-th scanning line). Further, in FIG. 2, "1H" represents a one-horizontal scanning period, "ΔT" represents a selection period, and Vc represents a reference potential which is identical to the voltage level of a non-selected scanning electrode.

Referring further to FIG. 2, each scanning (selection) signal includes a clear pulse Pe at a voltage level V1 and a write pulse Pw at a voltage level V2. More specifically, the scanning selection signal is used for clearing (or writing) into "black" by the first clear pulse Pe at V1, selecting "black (B)" or "white (W)" (dark or bright) state at the time of application of the write pulse Pw at V2, and for correcting or stabilizing the selected state by application of a correction pulse Pa at a level V5.

In other words, the correction pulse Pa having a voltage level V5 is applied for providing an increased drive margin. In the present invention, the voltage level V5 of the correction pulse Pa is selected within a prescribed range as indicated by a two-headed arrow in FIG. 2 so as to allow a good optical response of the liquid crystal based on temperature data from the temperature detection element 5.

Figure 3A:
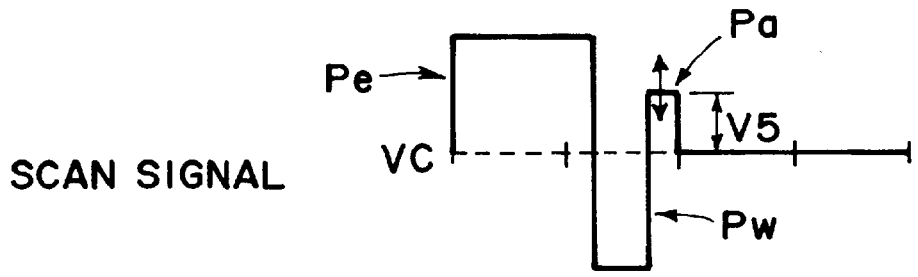
FIGS. 3A–3C are time-serial waveform diagrams for illustrating pixel voltages in First embodiment.
Figure 3B:
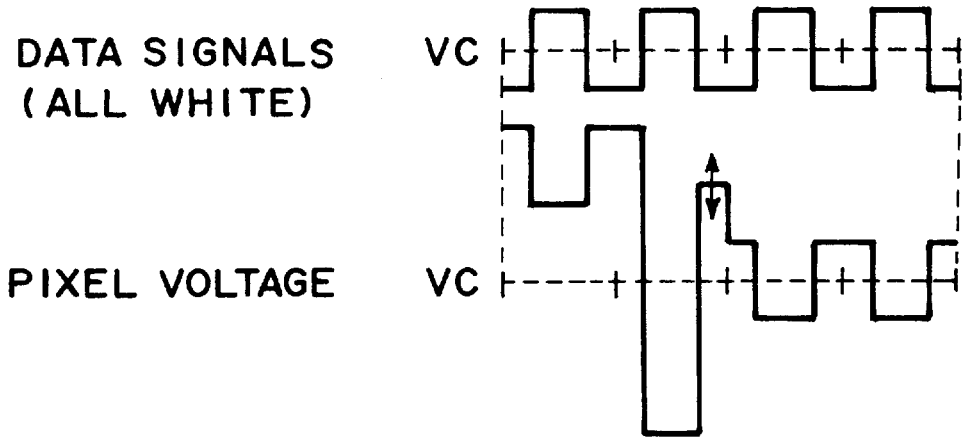
Figure 3C:
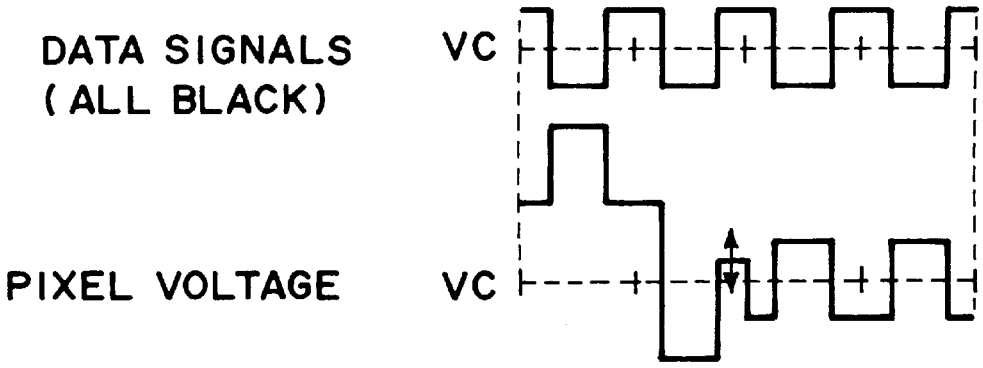

More specifically, when the liquid crystal display panel 6 is at a temperature higher than a certain reference temperature, i.e., when the liquid crystal is assumed to have a higher temperature, the voltage level V5 of the correction pulse Pa is changed to have a higher value (to provide a large voltage amplitude) with respect to the reference potential VC as indicated by an upward arrow in FIG. 3A (and also in FIG. 2). By elevating the voltage level V5 in this manner, a portion corresponding to the correction pulse Pa in the pixel voltage shown in FIG. 3C for displaying all "black" is also shifted to a higher side. As a result, a relevant pixel cleared into "black" by application of a pixel clear voltage is less liable to be inverted into "white" due to a subsequent relatively low write-phase pixel voltage of an opposite polarity.

On the other hand, when the liquid crystal is at a temperature lower than a certain reference temperature, the voltage level V5 of the correction pulse Pa is changed to approach the reference potential VC (to provide a smaller voltage amplitude) as indicated by a downward arrow in FIG. 3A. By lowering the voltage level V5, a portion corresponding to the correction pulse Pa in the pixel voltage shown in FIG. 3B for displaying all "white" is also changed to approach the reference potential VC. As a result, the switching into "white" is ensured even without applying a larger "white" switching voltage in a write-phase at such a lower temperature because the written "white" is latched with less-disturbance by addition of the reduced portion of an opposite polarity.

Figure 4:
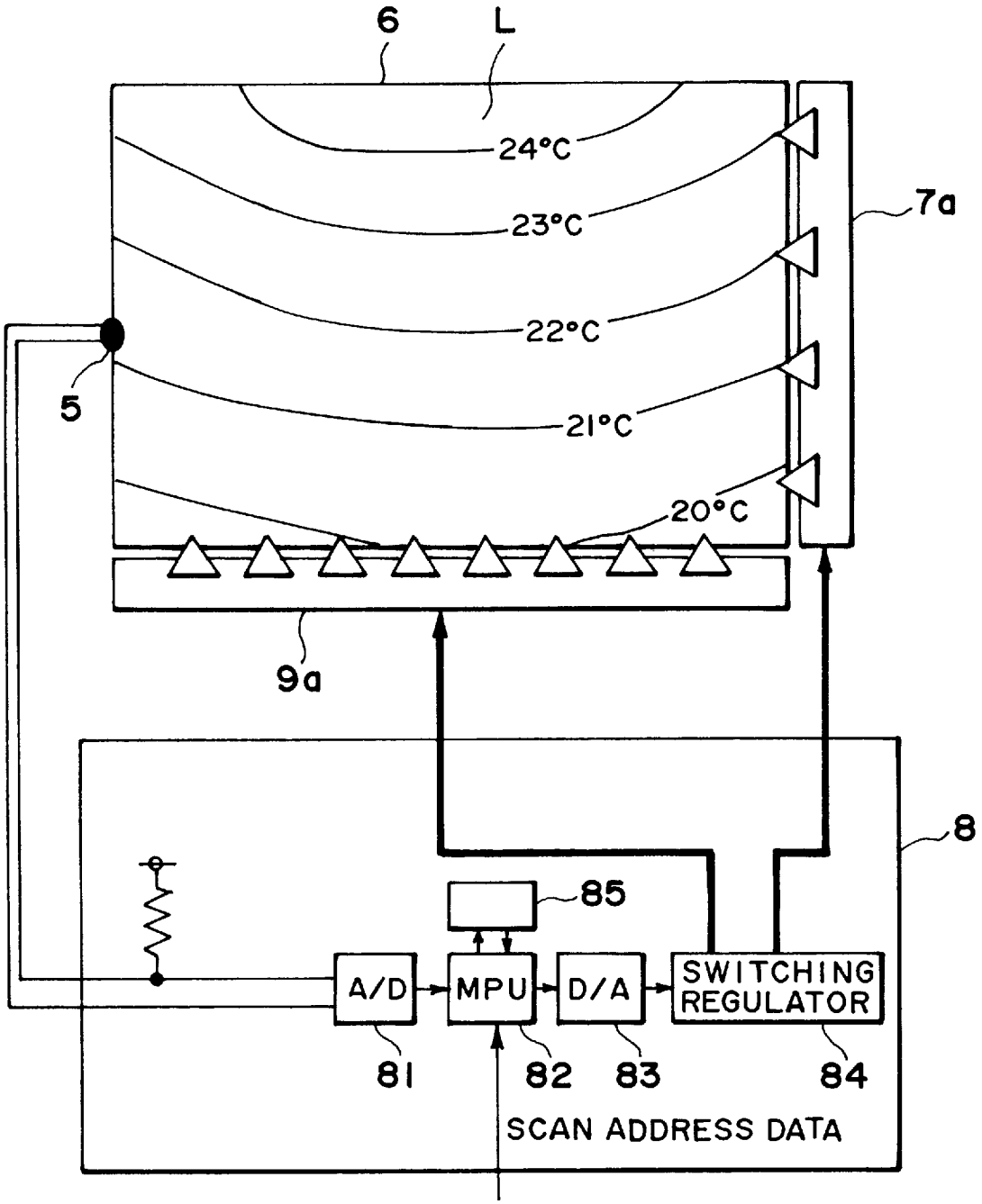
FIGS. 4 and 5 are each a block diagram of a voltage control unit used in another embodiment of the liquid crystal apparatus according to the invention.

FIG. 4 is a block diagram of the liquid crystal drive voltage control circuit 8 for changing the voltage level V5 of the correction pulse Pa depending on the liquid crystal temperature in the above-described manner. Referring to FIG. 4, the voltage control circuit 8 includes an A/D converter 81 for subjecting to temperature data of liquid crystal L at a prescribed position in the display panel 6 from the temperature detection element 5 to A/D conversion and a microprocessor unit (MPU) 82 receiving the A/D-converted temperature data and scanning address data from a host interface I/F (via a graphic controller 1A and a drive control circuit 2 shown in FIG. 1).

The MPU 82 is accompanied with a temperature compensation table 85 which is a table held in a memory (not shown) and showing a relationship between temperature data from the temperature detection element 5 and a temperature distribution of the liquid crystal within the panel and is designed to determine liquid crystal drive voltage levels for the respective scanning electrodes based on the data in the table 85, the inputted temperature data and scanning address data. The determined liquid crystal drive voltage level data is transmitted via a D/A converter 83 to a switching regulator 84.

Based on the liquid crystal drive voltage level determined based on the temperature compensation table 85, the switching regulator 84 supplies liquid crystal drive voltages having levels corresponding to the temperature of the liquid crystal to the scanning driver 7*a* of the scanning signal application circuit 7 (including further a decoder (not shown)). On the other hand, the data signal application circuit 9 (shown in FIG. 1) includes a data driver 9*a* (and also a shift register and a latch circuit, respectively not shown).

Another type of temperature compensation table is described.

It is also possible to detect temperature data of a liquid crystal device and take the temperature data into MPU (microprocessor unit) and determine application voltage levels based on the temperature data and a temperature compensation table written in advance in the MPU. More specifically, based on the detected temperature data, an average temperature over the liquid crystal device is estimated and, based on the estimated temperature, a scanning waveform having a suitable voltage level is applied to all the scanning electrodes to effect a good display over the entire picture display area of the panel.

A temperature compensation table as described above may be prepared in the following manner. First, a relationship between a temperature of a specific position (generally outside the display area) of the liquid crystal device and an average temperature over the entire display area of the liquid crystal device is determined through an experiment. Then, a relationship between a temperature and an application voltage level, i.e., a liquid crystal drive voltage level, for causing optimum optical response of liquid crystal molecules, is determined through an experiment. Based on the results of such two experiments, relationships among a detected temperature, an average temperature over the liquid crystal device and a suitable liquid crystal drive voltage level, are determined. By using such a temperature compensation table, it is possible to determine an appropriate liquid crystal drive voltage level from detected temperature data.

However, even if a scanning waveform having a liquid crystal drive voltage level suitable for such an average temperature is applied to the scanning electrodes, it is sometimes difficult to retain a good display quality because a liquid crystal has a peculiar temperature-dependent optical response characteristic and a liquid crystal device can have a high temperature at an upper part and a lower temperature at a lower part of the device as described above.

Accordingly, for maintaining a good display quality, it has been hitherto practiced to prepare a housing having a complex structure so as to reduce a temperature distribution along the liquid crystal device or an expensive liquid crystal material capable of exhibiting a good optical response to an identical drive waveform over a relatively broad temperature range. This incurs an increased production cost because of increased steps and material cost.

In contrast thereto, the temperature compensation table 85 in the above-mentioned embodiment retains a table comprising related data including temperature data from the temperature detection element 5, vertical temperature distribution along the liquid crystal device 6 determined based on the temperature data, and liquid crystal drive voltage level data corresponding to the temperature distribution. Further, in this embodiment, the temperatures of a liquid crystal at local position in a display area are not directly measured but evaluated from a temperature distribution table in the temperature compensation table from a measured temperature at a specific position of the display panel 6, so as to obtain evaluated temperatures and liquid crystal drive voltage data for respective scanning electrodes.

As described above, by evaluating a vertical temperature distribution of the liquid crystal along the display panel 6 based on temperature data from the temperature detection element 5 and finely adjusting the voltage level 5 of the correction pulse for each scanning electrode, it is possible to effect temperature compensation along the display panel 6. As a result, it becomes possible to effect a good display regardless of a temperature distribution along the display panel 6 in an inexpensive manner without using a housing of a complicated structure or an expensive liquid crystal material capable of exhibiting a good optical response to an identical drive waveform over a broad temperature range.

In the case of using a correction pulse Pa having a width equal to ¼ of 1H period as shown in FIG. 2, the voltage level of the correction pulse Pa may be easily adjusted in the remaining ¾ of 1H period. For example, in case where 1H is 32 μsec, 24 μsec can be allotted to the voltage level adjustment. In this embodiment, the total processing time of the MPU 82, the D/A converter 83 and the switching regulator 83 amounts to only several psec, so that the voltage adjustment can be effected in a time sufficiently shorter than 24 μsec.

Figure 5:
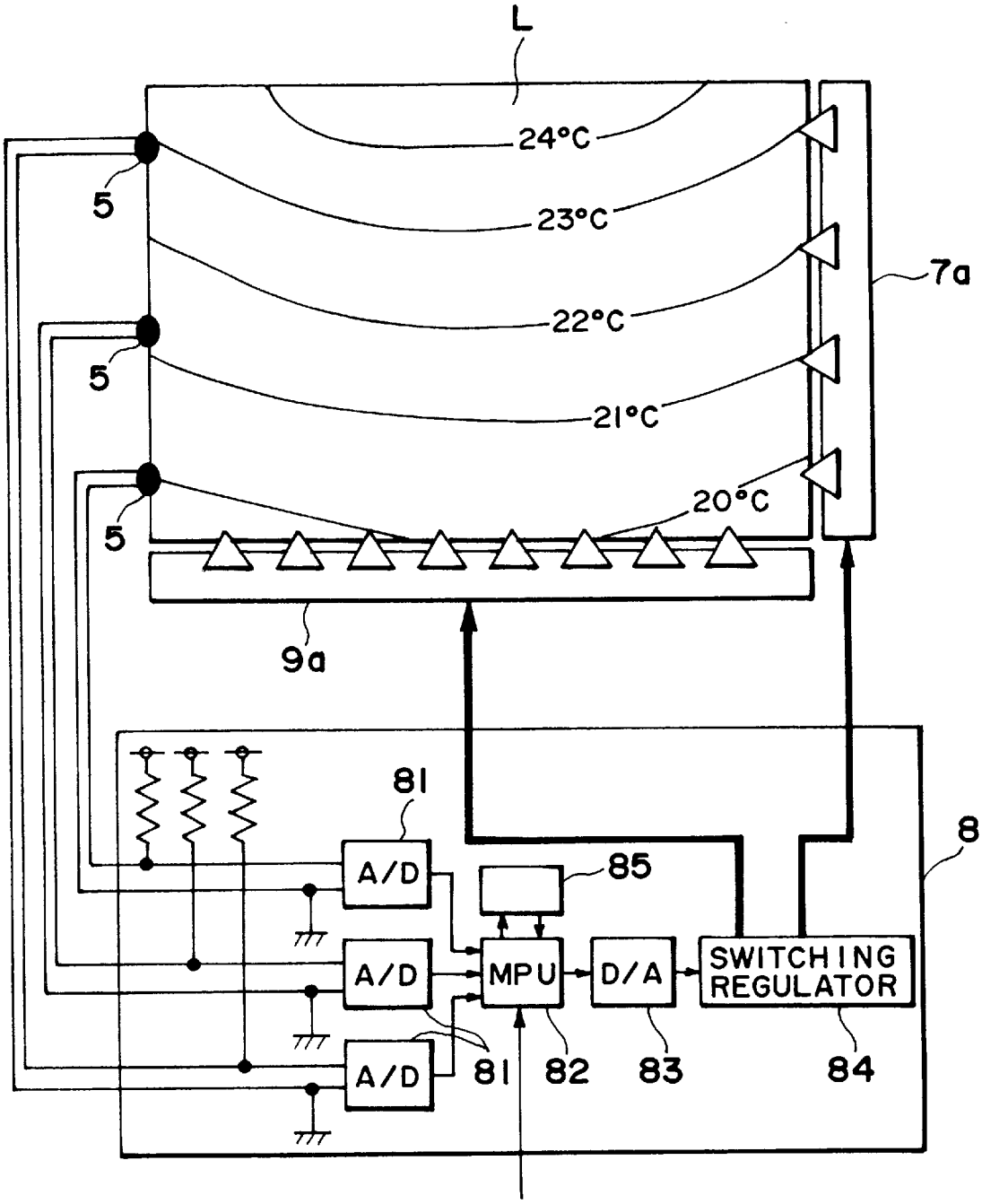

In the above-described embodiment, the temperature detection element 5 is disposed at only one position of the liquid crystal device 6, but it is possible to dispose a plurality (e.g., 3) of temperature detection elements at different positions of the liquid crystal device 6 as shown in FIG. 5. As a result, it is possible to more accurately evaluate a temperature distribution along the display panel 6 and apply further optimized scanning waveforms to the respective scanning electrodes.

The temperature detection element 5 can be disposed in a number of one or a plurality integrally with a liquid crystal device or separately from a liquid crystal device. Any position can be tolerable if it is possible to obtain a good correlation between detected temperature data and switching characteristics of the liquid crystal device.

The correction pulse Pa may preferably have a voltage amplitude (i.e., voltage level) V5 selected within a range of $VC<V5<V1$ depending on temperature. In the embodiment of FIG. 2, the pulses Pe and Pa have a positive polarity with respect to a reference voltage VC. In the case of applying a polarity-inverted scanning signal, the voltage level V5 may be selected within a range of $-VC>-V5>-V1$.

Further, in the case of using positive and negative drive voltages with reference to positive and negative two offset voltages $\pm V_{OST}$, reference voltages may be set at $VC\pm V_{OST}$.

In the above-described embodiment, only the voltage level of the correction pulse Pa is changed depending on temperature. It is however possible to change the voltage level V2 of the write pulse Pw in addition to that of the correction pulse Pa as in Second embodiment described below.

Figure 6A:
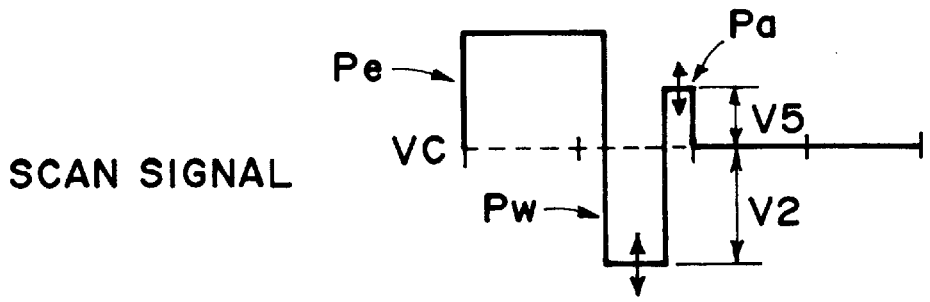
FIGS. 6A–6C show time-serial wave form diagrams showing a partial set of drive signals used in Second embodiment of the invention.
Figure 6B:
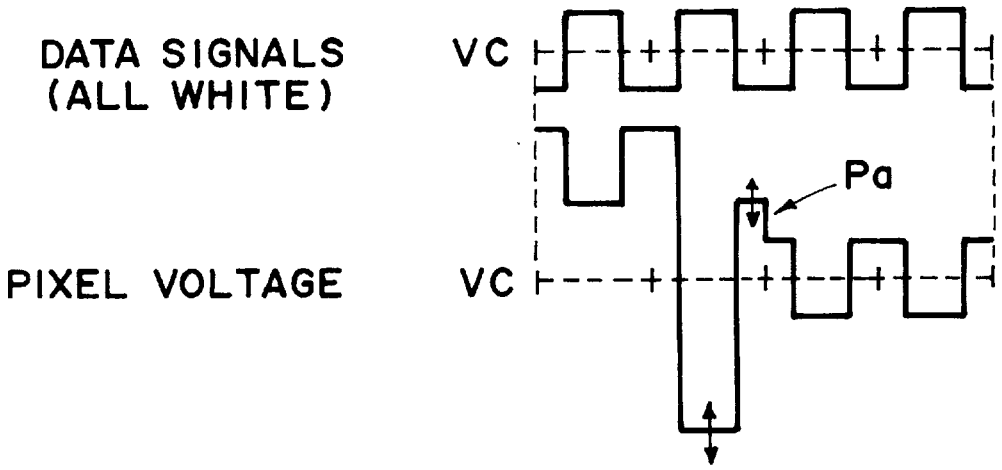
Figure 6C:
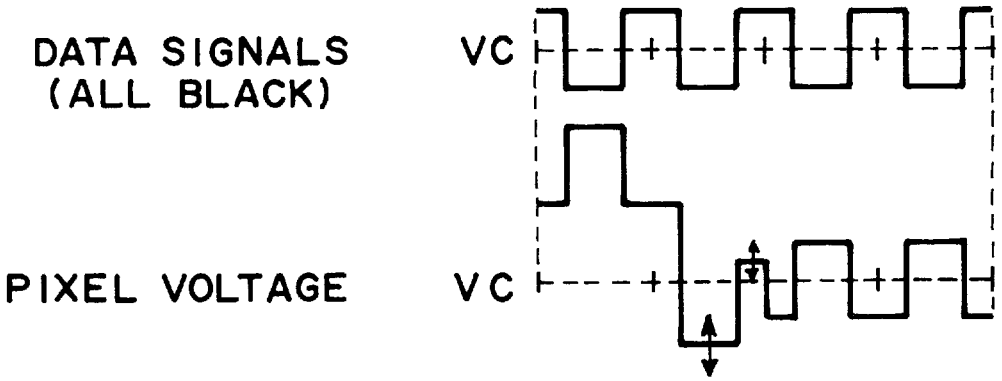

FIGS. 6A–6B show drive waveforms used in a liquid crystal apparatus according to Second embodiment. More specifically, FIG. 6A shows a scanning signal applied to a scanning electrode; FIG. 6B shows a succession of data signals applied to a data electrode for writing "black" at all pixels on the data electrode, and a pixel voltage applied to a pixel at the intersection of the data electrode and the scanning electrode; and FIG. 6C shows a succession of data signals applied to a data electrode for writing "white" at all pixels on the data electrode, and a pixel voltage applied to a pixel at the intersection of the data electrode and the scanning electrode. In this embodiment, so as to provide a good optical response of the liquid crystal, the voltage level V2 of a write pulse Pw is changed as indicated by a two-headed arrow in addition to the voltage level V5 of the correction pulse Pa as shown in FIG. 6A based on temperature data from the temperature detection element 5.

More specifically, when the temperature of liquid crystal L is at a temperature higher than a reference temperature, the voltage level V2 of the write pulse Pw is changed as indicated by an upward arrow in FIG. 6A to provide a smaller amplitude (potential difference fro the reference potential VC). As a result, the corresponding portion of the pixel voltage shown in FIG. 6C in the case of writing "black" at all pixels is caused to approach the reference potential VC (i.e., have a smaller voltage amplitude), thus decreasing the liability of switching to a "white" state.

On the other hand, when the temperature of the liquid crystal L is lower than a reference temperature, the voltage level V2 of the write pulse Pw is changed as indicated by a downward arrow in FIG. 6A to provide a larger amplitude (potential difference from the reference potential VC). As a result, the corresponding portion of the pixel voltage shown in FIG. 6B in the case of writing "white" at all pixels is caused to have a larger voltage amplitude (potential difference from the reference potential VC), thus ensuring a switching to "white".

In this embodiment, the voltage level V5 of the correction pulse Pa is changed as also indicated by a two-headed arrow in addition to the voltage level V2 of the write pulse Pw as shown in FIG. 6A based on temperature data from the temperature detection element 5.

Thus, when the temperature of liquid crystal L is at a temperature higher than a reference temperature, the voltage level V5 of the correction pulse Pa is changed as indicated by an upward arrow in FIG. 6A to provide a larger amplitude (potential difference from the reference potential VC). As a result, the corresponding portion of the pixel voltage shown in FIG. 6C in the case of writing "black" at all pixels is cause to leave the reference potential VC (i.e., have a larger voltage amplitude), thus decreasing the liability of switching to a "white" state in combination with the change in voltage level V2 of the write pulse Pw.

On the other hand, when the temperature of the liquid crystal L is lower than a reference temperature, the voltage level V5 of the correction pulse Pa is changed as indicated by a downward arrow in FIG. 6A to provide a smaller amplitude (potential difference from the reference potential VC). As a result, the corresponding portion of the pixel voltage shown in FIG. 6B in the case of writing "white" at all pixels is caused to have a smaller voltage amplitude (potential difference from the reference potential VC), thus ensuring a switching to "white" in combination with the change in voltage level V2 of the write pulse Pw.

In the above embodiment, the voltage amplitudes of the correction pulse and the write pulse are subjected to temperature compensation.

In a third embodiment, it is possible to determine the duration of one horizontal scanning period (1H) in addition to the voltage amplitude of the correction pulse depending on the temperature. For example, if Href is assumed to represent the duration of one horizontal scanning period and $V5_{ref}$ is assumed to represent the voltage amplitude of a correction pulse Pa, respectively, at a prescribed reference temperature, the duration of one horizontal scanning period is made longer than Href at a temperature lower than the reference temperature. As a result, the pulse widths of the write pulse and the correction pulse are made longer proportionally. At this time, the voltage amplitude of the correction pulse is simultaneously made smaller than $V5_{ref}$.

On the other hand, when the temperature is higher than the reference temperature, the duration of one horizontal scanning period is made shorter than Href to shorten the pulse widths of the write pulse and the correction pulse, and simultaneously the voltage amplitude of the correction pulse is made larger than $Vr_{ref}$. As a result, it is possible to effect a good display over a broader temperature range.

In the above, the description has been made with reference to a liquid crystal apparatus wherein the scanning electrodes can be selected in an arbitrary order according to scanning address data. The present invention is however also applicable to a liquid crystal apparatus driven by a non-interlaced scanning scheme or an interlaced scanning scheme.

Figure 7:
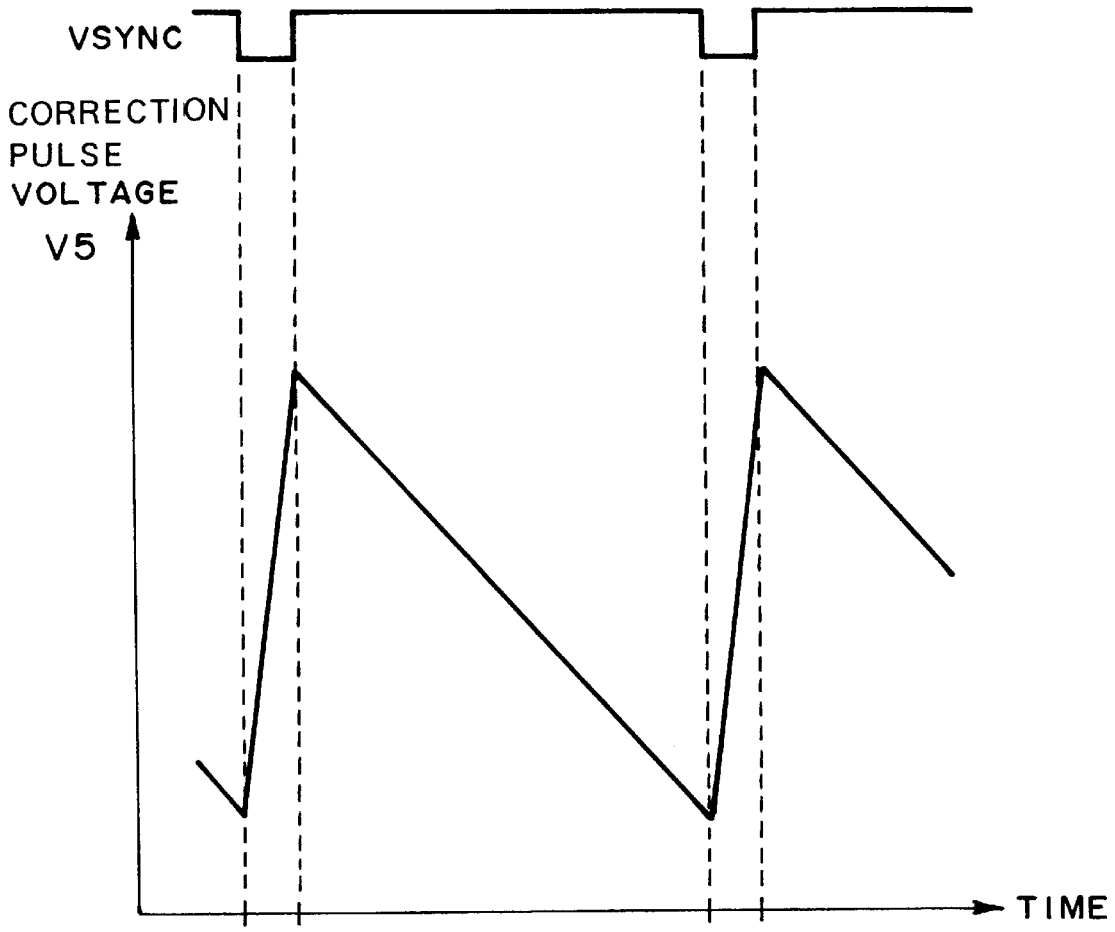
FIG. 7 is a voltage waveform diagram showing a change with time of a correction pulse voltage level of a scanning signal applied to a liquid crystal device in a non-interlaced manner.
Figure 8:
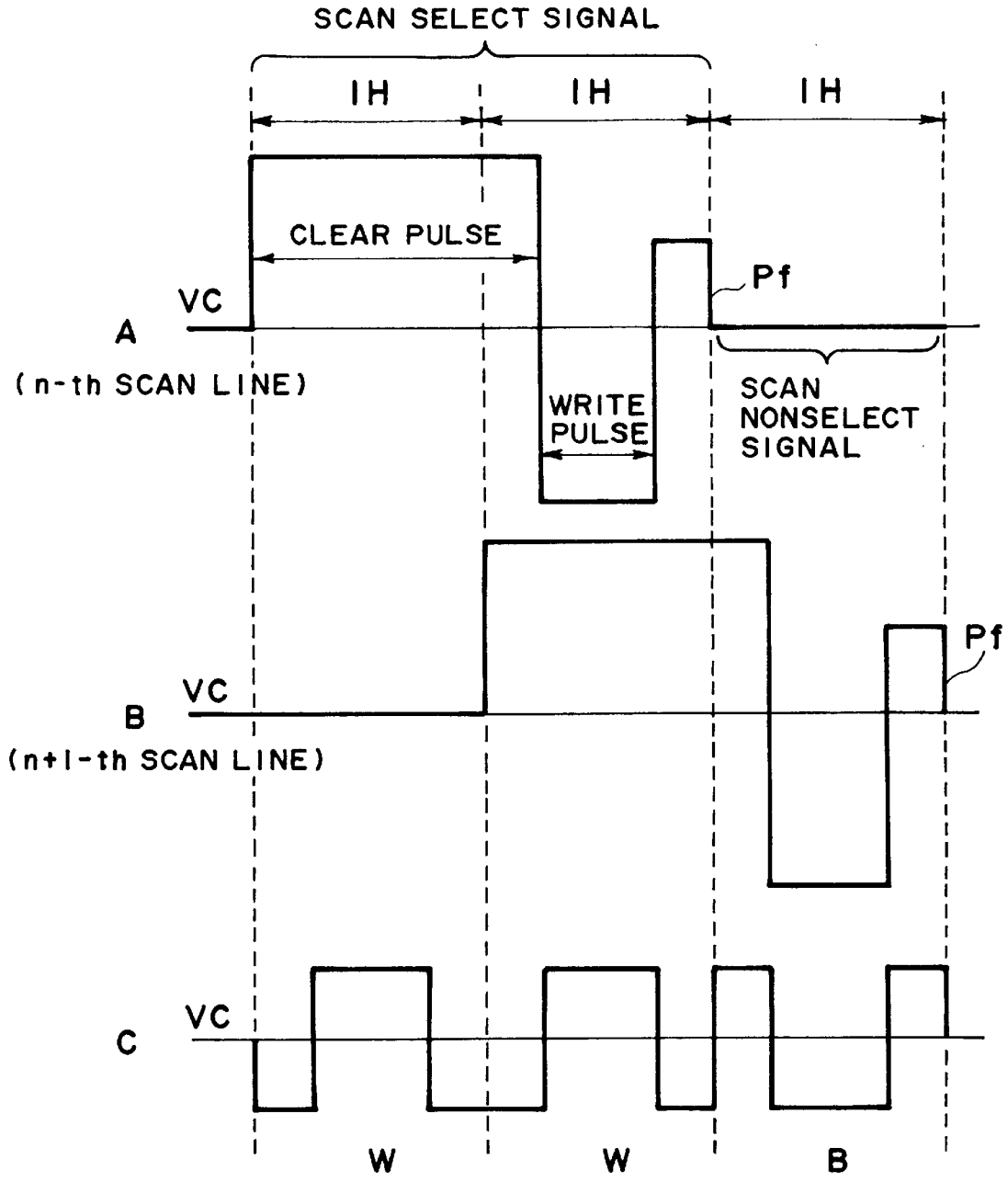
FIG. 8 is a time-serial waveform diagram showing a partial set of drive signals used in a conventional liquid crystal apparatus.
Figure 9A:
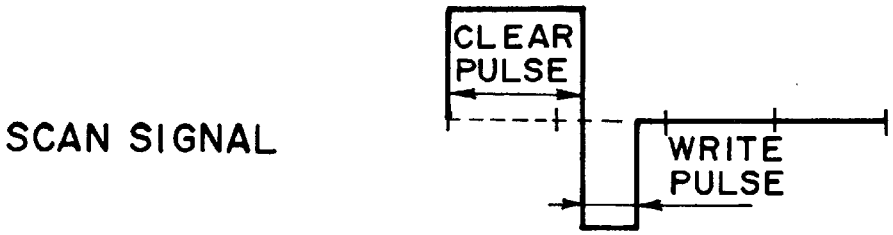
FIGS. 9A–9C are time-serial waveform diagrams for illustrating pixel voltages applied in a conventional liquid crystal apparatus.
Figure 9B:
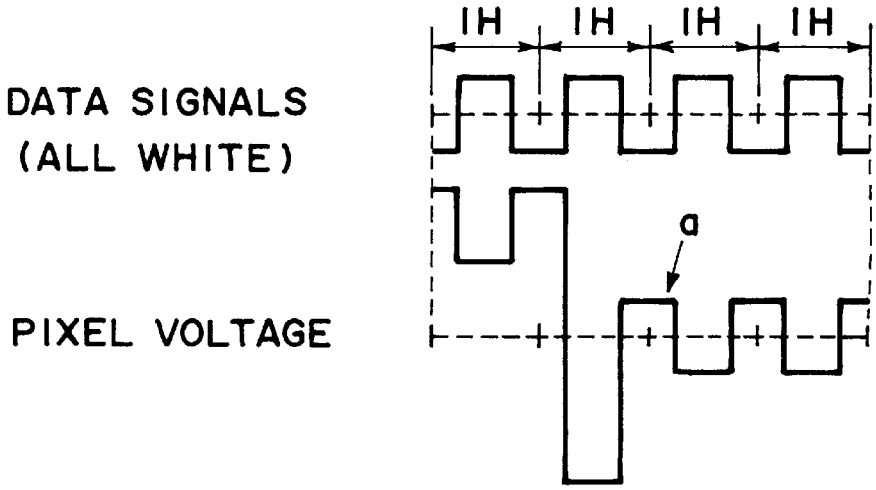
Figure 9C:
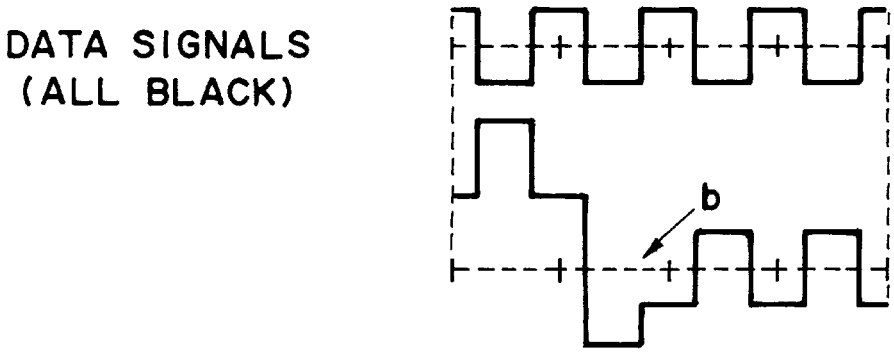

FIG. 7 shows a scanning signal waveform applicable to a liquid crystal apparatus according to Fourth embodiment of the present invention. More specifically, FIG. 7 shows a change with time of voltage amplitude V5 of a correction pulse. Referring to FIG. 7, $V_{sync}$ represents a vertical synchronization signal. Immediately after $V_{sync}$ is at a high level, the scanning of a first scanning electrode is started (whereas no scanning electrodes are scanned when $V_{sync}$ is low), and then second, third, . . . n-th . . . scanning electrodes are sequentially scanned. Physically, the above sequence means that the uppermost scanning electrode is selected immediately after $V_{sync}$ is enabled (placed at a high level) and then lower scanning electrodes are selected sequentially, i.e., to lower parts of the liquid crystal device.

As described above, a liquid crystal device (panel) 6 vertically held tends to have a higher temperature at an upper part and a lower temperature at a lower part, so that the voltage amplitude V5 of the correction pulse is increased immediately after enablement of $V_{sync}$ and then gradually decreased for lower scanning electrodes corresponding to the temperature distribution in a vertical direction of the liquid crystal device 6 so as to effect temperature compensation according to the present invention.

The gradual decrease of the voltage amplitude V5 of the correction pulse of a scanning signal may be performed according to temperature data from the temperature detection element 5 and a table showing a relationship between the temperature data and temperature distribution of liquid crystal L in the device.

In the above embodiments, the voltage amplitude (and pulse width) can be set or determined for each scanning electrode or for a group of physically adjacent plural scanning electrodes.

Only one or a plurality of reference temperatures can be used for setting the voltage amplitude (and the pulse width). For example, it is preferred to use a number of reference temperatures which are selected for 2–3° C. each so as to effect fine adjustment of the voltage amplitude (and the pulse width).

As described above, according to the present invention, the voltage level(s) of a scanning signal may be changed for respective scanning electrodes based on temperature data obtained by a temperature detection element for a liquid crystal device so as to compensate for a temperature distribution of liquid crystal along the liquid crystal device. As a result, a good display can be effected over an entire area of a liquid crystal device without using a housing having a complex structure for minimizing a temperature distribution along the liquid crystal device, thus allowing a reduced production cost.

What is claimed is:

1. A liquid crystal apparatus, comprising:

a liquid crystal device comprising a pair of substrates having thereon a group of scanning electrodes and a group of data electrodes intersecting the scanning electrodes so as to form an electrode matrix, and a liquid crystal disposed between the substrates so as to form a pixel at each intersection of the scanning electrodes and the data electrodes, temperature-detection means for detecting a temperature of the liquid crystal device, drive means for applying a scanning signal comprising a clear pulse, a write pulse and a correction pulse to the scanning electrodes and for applying data signals to the data electrodes in synchronism with the scanning signal, and voltage control means for changing a voltage level of the correction pulse based on temperature data from the temperature-detection means, wherein the voltage control means changes the voltage level of the correction pulse based on a table showing a relationship between the detected temperature and a temperature distribution of the liquid crystal device.

2. An apparatus according to claim 1, wherein the voltage control means sets a smaller voltage amplitude of the correction pulse when the detected temperature is lower and a larger voltage amplitude when the detected temperature is higher.

3. An apparatus according to claim 1 or 2, wherein the voltage control means further changes the voltage level of the write pulse of the scanning signal based on the temperature data.

4. An apparatus according to claim 1 or 2, wherein the voltage control means further changes at least one of a pulse width of the write pulse and a pulse width of the correction pulse.

5. An apparatus according to claim 1 or 2, including a plurality of the temperature detection means disposed at different positions along the liquid crystal device.

6. An apparatus according to claim 1 or 2, wherein said liquid crystal is a chiral smectic liquid crystal.

7. An apparatus according to claim 1 or 2, wherein said liquid crystal is a ferroelectric liquid crystal.

8. An apparatus according to claim 1, wherein, at a lower temperature, the write pulse is set to have a larger voltage amplitude and the correction pulse is set to have a smaller voltage amplitude; and, at a higher temperature, the write pulse is set to have a smaller voltage amplitude and the correction pulse is set to have a larger voltage amplitude.

9. An apparatus according to claim 1, wherein, at a lower temperature, the write pulse and the correction pulse are respectively set to have a larger pulse width and the correction pulse is set to have a smaller voltage amplitude; and, at a higher temperature, the write pulse and the correction pulse are respectively set to have a smaller pulse width and the correction pulse is set to have a larger voltage amplitude.

10. An apparatus according to any of claims 1, 2 and 8–9, wherein the correction pulse is caused to have voltage levels independently set for at least two scanning electrodes depending on temperatures.

11. An apparatus according to any of claims 1, 2 and 8–9, wherein the clear pulse and the correction pulse have one polarity, and the write pulse has the other polarity, respectively with respect to a prescribed potential.

12. A driving method for a liquid crystal device of the type comprising a pair of substrates having thereon a group of scanning electrodes and a group of data electrodes intersecting the scanning electrodes so as to form an electrode matrix, and a liquid crystal disposed between the substrates so as to form a pixel at each intersection of the scanning electrodes and the data electrodes; said driving method comprising:

detecting a temperature of the liquid crystal device by temperature detection means, sequentially applying a scanning signal comprising a clear pulse, a write pulse and a correction pulse to the scanning electrodes and applying data signals to the data electrodes in synchronism with the scanning signal, and changing a voltage level of the correction pulse based on temperature data from the temperature detection means, wherein the voltage level of the correction pulse is changed based on a table showing a relationship between the detected temperature and a temperature distribution of the liquid crystal device.

13. A method according to claim 12, wherein the correction pulse is set to have a smaller voltage amplitude when the detected temperature is lower and a larger voltage amplitude when the detected temperature is higher.

* * * * *

UNITED STATES PATENT AND TRADEMARK OFFICE

CERTIFICATE OF CORRECTION

PATENT NO. : 5,903,251

DATED : May 11, 1999

INVENTOR(S) : HIDEO MORI, ET AL.

It is certified that error appears in the above-identified patent and that said Letters Patent is hereby corrected as shown below:

Title page,

AT [56] REFERENCES CITED

FOREIGN PATENT DOCUMENTS

"2281233" should read --2-281233--.

COLUMN 2

Line 1, "waveformed" should read --waveform--; and
Line 6, "waveformed" should read --waveform--.

COLUMN 3

Line 2, "First" should read --a first--;
Line 5, "First" should read --the first--;
Line 9, "wave form" should read --waveform--;
Line 10, "Second" should read --a second--; and
Line 64, "to" should be deleted.

COLUMN 4

Line 32, "control" should read --control data,--.

COLUMN 5

Line 49, "less-disturbance" should read --less disturbance--.

COLUMN 6

Line 16, "respectively" should read --respectively,--.

UNITED STATES PATENT AND TRADEMARK OFFICE

CERTIFICATE OF CORRECTION

PATENT NO. : 5,903,251

DATED : May 11, 1999

INVENTOR(S) : HIDEO MORI, ET AL.

It is certified that error appears in the above-identified patent and that said Letters Patent is hereby corrected as shown below:

COLUMN 7

Line 55, "positive and negative two" should read --two positive and negative--;
Line 61, "Second" should read --a second--; and
Line 65, "Second" should read --a second--.

COLUMN 8

Line 18, "fro" should read --from--; and
Line 45, "cause" should read --caused--.

COLUMN 9

Line 26, "Fourth" should read --a fourth--.

Signed and Sealed this

Fourteenth Day of March, 2000

*Attest:*

*Attesting Officer*

Q. TODD DICKINSON

*Commissioner of Patents and Trademarks*